United States Patent [19]

Rickman et al.

[11] 4,441,480

[45] Apr. 10, 1984

[54] IGNITION INDICATOR FOR GAS GRILLS

[75] Inventors: Mark A. Rickman, Lyndhurst; Murray Leonard, Mayfield, both of Ohio

[73] Assignee: Vernitron Corporation, Lake Success, N.Y.

[21] Appl. No.: 222,751

[22] Filed: Jan. 5, 1981

Related U.S. Application Data

[63] Continuation of Ser. No. 941,070, Sep. 11, 1978, abandoned.

[51] Int. Cl.[3] ..... F24J 3/02

[52] U.S. Cl. ..... 126/42; 126/41 R; 126/351; 431/44; 431/191; 431/153

[58] Field of Search ..... 126/41, 351, 42, 41 R; 431/13–17, 153, 6, 44

[56] References Cited

U.S. PATENT DOCUMENTS

| | | | |
|---|---|---|---|
| 2,361,530 | 10/1944 | Burch | 431/13 X |
| 3,174,534 | 3/1965 | Weber | 431/44 |
| 3,174,535 | 3/1965 | Weber | 431/44 |
| 3,498,284 | 3/1970 | Swaddey | 126/41 |
| 4,035,136 | 7/1977 | Howatt et al. | 431/191 |
| 4,115,832 | 9/1978 | Nakamura et al. | 361/256 |
| 4,188,937 | 2/1980 | Baynes | 126/41 R |

*Primary Examiner*—Larry Jones

*Attorney, Agent, or Firm*—Fay & Sharpe

[57] ABSTRACT

A gas grill having a visible indicator for indicating ignition of the grill burner. The indicating device includes a sensing device mounted adjacent the burner on a common bracket with a burner igniter. The control for the igniter is mounted in a common housing with the ignition indicator. An encapsulated spark gap, neon bulb, or similar device is connected with the spark igniter for indicating that a spark has jumped an electrode gap.

11 Claims, 9 Drawing Figures

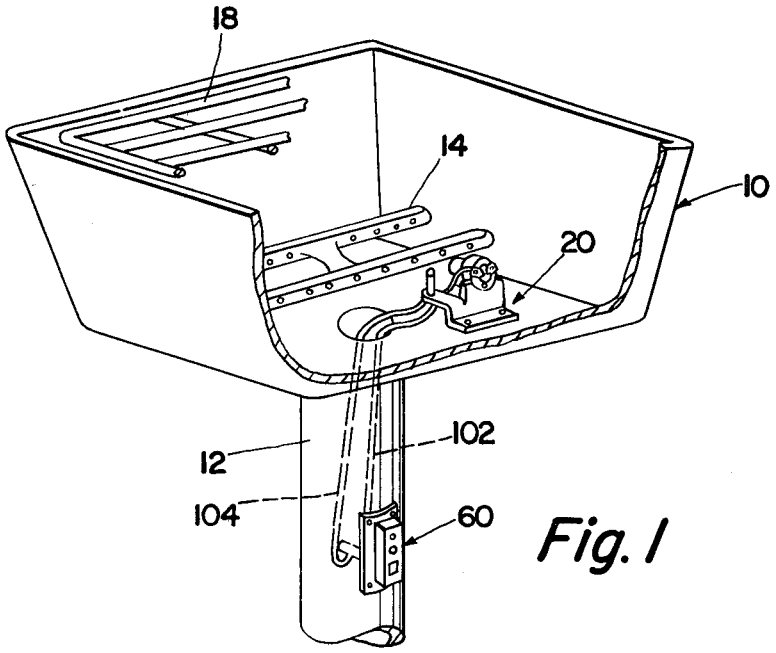
Fig. 1
Fig. 2
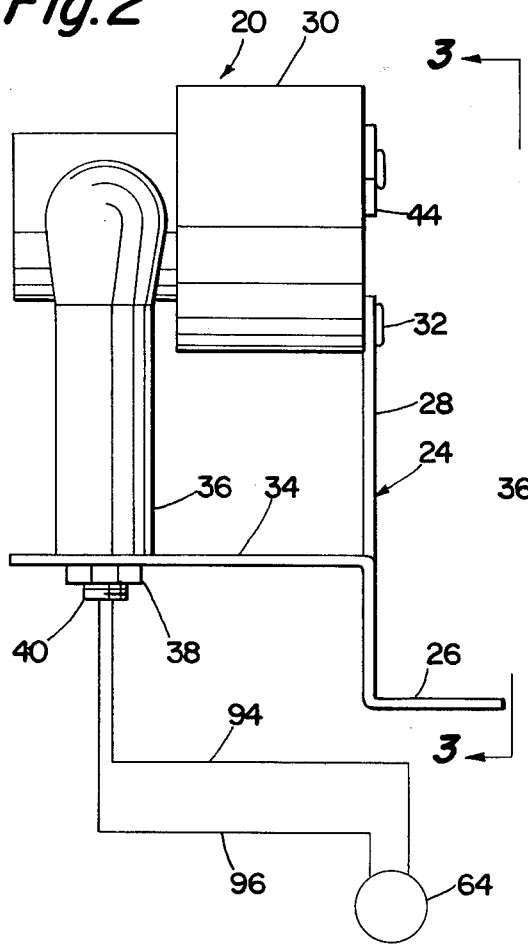
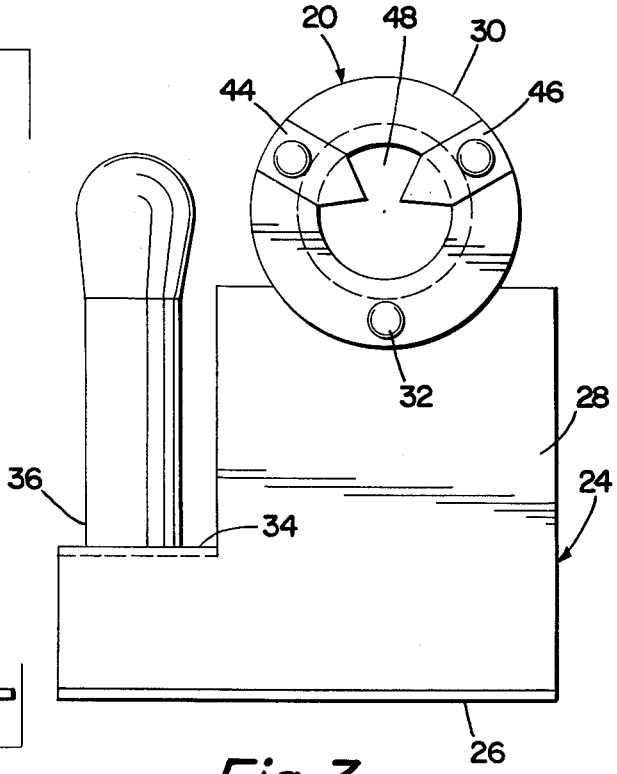
Fig. 3

IGNITION INDICATOR FOR GAS GRILLS

This is a continuation of application Ser. No. 941,070, filed Sept. 11, 1978 now abandoned.

The invention relates generally to gas grills and, more particularly, to ignition systems for gas grills.

With the cover of a gas grill in its closed position, and the gas supply to the burner turned on, an explosive mixture of gas and air will soon build up inside of the grill if the burner is not ignited. An attempt at igniting the burner under these conditions can result in an explosion. If burner ignition is not made shortly after turning the gas supply on, or if the flame blows out, it is desirable that the grill cover be raised for clearing the explosive mixture from inside the grill before ignition is attempted.

It would be desirable to have an arrangement for indicating to a user whether or not the grill burner is ignited. This would inform a user whether or not the grill is operating properly, and would warn the user against attempted ignition without first exhausting the interior of the grill.

Various prior arrangements exist for indicating ignition of gas burners in general. However, none of these are particularly applicable for gas grills and, more particularly, to gas grills of the type which are equipped with ignition systems. Examples of gas burner flame detectors include U.S. Pat. No. 2,766,440 issued Oct. 9, 1956, to Marsden who positions a sensing device adjacent a gas burner for generating a voltage when the burner is ignited. The voltage is amplified and used for operating a meter. U.S. Pat. No. 2,761,005 issued Aug. 28, 1956, to Chamberlain discloses a thermocouple positioned for impingement by a gas burner flame and provides a readout on a meter. U.S. Pat. No. 3,174,533 issued Mar. 23, 1965, to Weber discloses a spark ignition system for gas burners, and the system includes a device for holding a valve open when proper ignition occurs. Failure of burner ignition results in closing of the valve to provide the indication that ignition has failed. U.S. Pat. No. 3,136,355 issued June 9, 1964, to Weber is of general interest for a piezoelectric ignition system including a device responsive to the burner flame for arming the piezoelectric igniter.

Prior ignition indicators for gas burners are not easily installed in conventional gas grills in an inexpensive manner. This is particularly true in gas grills of the type provided with electric igniters.

Piezoelectric igniters sometimes fail to generate sufficient voltage to cause a spark across an electrode gap. It would be desirable to have an arrangement for indicating to a user whether a spark has been generated when the igniter is operated.

It is therefore the primary object of the present invention to provide an ignition indicator which is very inexpensive to manufacture and simple to assemble.

It is a further object of the invention to provide an ignition indicator which is mounted on a common bracket with an electric igniter.

It is an additional object of the invention to provide an ignition indicator having an indicating device mounted in a common housing with a control for operating an electrical igniter.

It is also an object of the invention to provide a piezoelectric ignition system with an indicator for indicating whether or not an ignition spark has been generated when the igniter control is operated.

An aspect of the present invention resides in providing sensing means mounted adjacent a gas grill burner for sensing ignition of the burner. Visible indicator means external of the grill housing is responsive to the sensing means for indicating burner ignition.

The sensing means may be mounted on a common bracket with burner ignition means. The control for the ignition means may be mounted in a common housing with the visible indicator means.

In another aspect of the invention, a lightbulb is connected with a piezoelectric voltage source and a spark gap for indicating that a spark has jumped the gap when the igniter control is operated.

For a better understanding of the present invention, together with other and further objects thereof, reference is made to the following description taken in connection with the accompanying drawings, and its scope will be pointed out in the appended claims.

In the drawing:

FIG. 1 is a partial perspective illustration of a gas grill having the improvements of the present application incorporated therein, and with a portion of the grill housing cut-away for clarity of illustration;

FIG. 2 is a side elevational view of an indicator and igniter assembly;

FIG. 3 is a rear elevational view taken generally on line 3—3 of FIG. 2;

Figure 4:
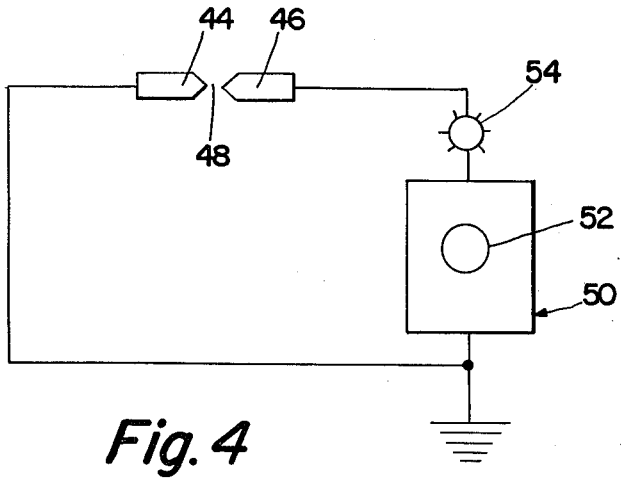
FIG. 4 is a schematic circuit diagram showing a visible indicator connected with a piezoelectric voltage source.

Referring now to the drawing, and particularly to FIG. 1, there is shown a portion of a conventional gas grill having a dished bottom housing 10 to which a cover is normally hinged in a known manner. The housing 10 is supported on a hollow vertical post 12 or other suitable support structure through which a suitable gas supply line extends to a gas burner 14 in the lower portion of the housing 10. A suitable gas flow control means or valve is provided in a known manner on the post 12 for controlling the supply of gas to the burner 14.

A burner igniter and flame sensing assembly 20 is mounted to the bottom wall of the housing 10 adjacent the burner 14. The burner igniter and flame sensing assembly 20 includes a metal mounting bracket 24 having a bottom horizontal leg 26 with suitable holes therethrough for bolting same to the bottom wall of the housing 10. A vertical bracket leg 28 has a flash tube 30 suitably secured thereto as by a rivet 32. A horizontal bracket leg 34 has a flame or ignition sensing device or means 36 for sensing an ignited or unignited ignition state of the burner, which is suitably secured thereto as by a nut 38 threaded over an extension 40 on the sensing device 36 extending through a suitable hole in the leg 34.

A pair of electrodes 44 and 46 are secured to the rear of the flash tube 30 and have electrode tips spaced-apart to define a spark gap generally indicated at 48 in FIG. 3. As shown in FIG. 4, the electrodes 44, 46 are connected to a suitable ignition control means for supplying electrical potential to the electrodes. The ignition control means includes piezoelectric high voltage source 50 which may be of any suitable type, including those disclosed in U.S. Pat. No. 3,449,637 issued June 10, 1969, to Suzuki or U.S. Pat. No. 3,469,119 issued Sep. 23, 1969, to Parkinson. The ignition control means further includes a pushbutton 52 is manually depressed for stressing the piezoelectric crystal to generate a voltage across the electrodes 44, 46 and cause a spark to jump the spark gap 48. A spark indicator means including a small lightbulb 54 is connected in series with the voltage source 50 and the electrode 46, and the bulb 54 will light when a spark jumps the gap 48 to indicate that a proper burner igniting spark has been generated. It sometimes happens that a spark does not jump the gap 48 when the pushbutton 52 is depressed and the bulb 54 will inform a user when a proper spark has been generated for achieving burner ignition.

Figure 5:
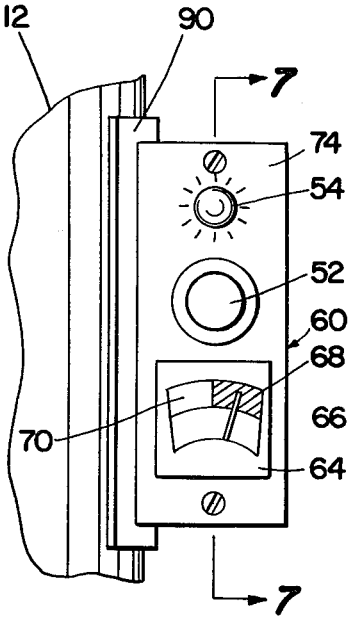
FIG. 5 is a front elevational view of a housing having an igniter control and an ignition indicator mounted therein.
Figure 6:
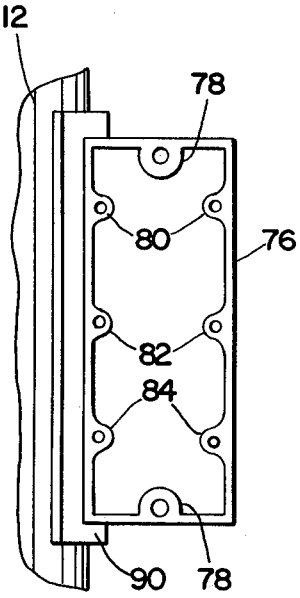
FIG. 6 is a front elevational view of the housing of FIG. 5, and with the cover and internal components removed.
Figure 7:
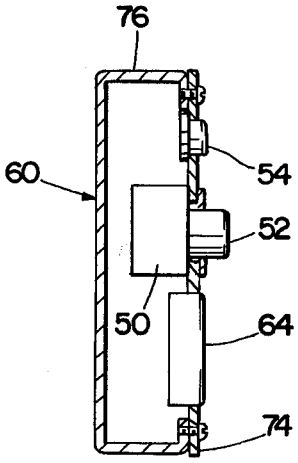
FIG. 7 is a cross-sectional elevational view taken generally on line 7—7 of FIG. 5.

FIGS. 5–7 show a housing 60 for mounting the voltage source 50 and bulb 54 of FIG. 4, along with mounting visible ignition indicating means 64 which is connected for responding to the sensing means 36 to provide a visible indication of burner ignition state. The visible indicator means is shown as including a needle or pointer 66 which moves from a normal position to the left of where it is shown in FIG. 5, to the position shown when burner ignition has occurred. A background area at 68 may be red to indicate burner ignition, while another area 70 may be white to indicate that the burner is not ignited. Obviously, other visible indicators and meters may be used if so desired.

The housing 60 includes a cover 74 removably secured to a base 76 having opposite threaded bosses or ears 78 for receiving screws to secure the cover 74 to the base 76. The bulb 54, the voltage source 50 and the visible indicator 64, may all be mounted on brackets having flanges with suitable holes through which screws are extended for securing same to the housing base 76. Opposite tapped bosses or ears 80 are provided for mounting the bracket for the bulb 54. Opposite bosses or ears 82 are provided for mounting the voltage source 50. Opposite bosses or ears 84 are provided for mounting the visible indicator means 64. A suitable flange 90 is provided on the housing base 76 for mounting the housing 60 to the upright post 12.

It will be recognized that the sensing means 36 and the visible indicator means 64 may take many different forms. For example, the sensing means 36 may be a thermocouple or other similar device which generates a small current when heated. The thermocouple is connected by suitable wires 94, 96 of FIG. 2 to the indicator 64 which may be a sensitive electric meter. The sensing means 36 can also be in the form of a gas or liquid expander connected with a bellows having an indicating needle attached thereto or connected therewith through a mechanical linkage. Heating of the gas or liquid expander by burner ignition will move the indicator. The sensing means 36 may also be in the form of a bi-metallic twister having the needle 66 or other indicator attached thereto or connected thereto by a mechanical linkage. Twisting movement of the bi-metallic twister upon heating thereof by burner ignition causes the indicator to move into the burner ignited position. It is also possible to provide arrangements using a small battery for operating an indicator. For example, a simple bimetal bender may be mounted adjacent the burner 14 for closing a switch when the burner is ignited for completing a circuit from a battery to a meter or bulb forming the indicating device 64. A similar arrangement may be provided with a photocell in place of the bimetal for closing a switch or completing a circuit. It is also possible to use a thermistor in series with a battery and a meter. It is further possible to provide a larger battery connected with an audible buzzer or the like. The circuit through the buzzer would be turned on after the burner is ignited and the visible indicator has moved to the burner on position. Movement of the indicator to the burner on position would open a switch to maintain the buzzer off. However, failure of the burner flame would cause closing of that switch and energize the buzzer for indicating flame failure. It will be recognized that many different sensing devices may be used for the sensing means 36 and the specific details of such devices form no part of the present application. The sensing device may be one which generates an electrical current when heated or may be one which provides a mechanical movement on being heated.

It will be recognized that the improved ignition indicating means may be provided with gas grills which do not have electric ignition, and that it may also be provided with gas grills having ignition devices of types other than piezoelectric. Arranging the ignition sensing means 36 and the burner igniter defined by the flash tube 30 on a common bracket greatly simplifies manufacture and assembly of the device. In addition, it has been found very advantageous to mount the igniter control or voltage source 50 in a common housing 60 with the visible indicating means 64. The common housing is simply attached to the upright grill post 12. Elongated cable means such as electrical wires generally indicated at 102 and 104 in FIG. 1 extend through the hollow post 12 from the devices in the housing 60 to the sensing and igniting assembly 20.

The pushbutton 52 provides a control means for operating the ignition means defined by the electrodes 44, 46 and the spark gap 48. The bulb 54 defines spark indicator means for indicating when a proper spark has been generated upon operation of the control means 52. If the bulb 54 does not light upon operation of the control means 52, a user will immediately be aware that the control 52 should again be operated for producing the necessary spark to effect ignition.

In addition to flame sensing and indicating arrangements of the type previously discussed, it will be recognized that it is possible to use known temperature sensing and indicating devices such as those discussed on pages 16–13 through 16–17 of the Mechanical Engineers' Handbook by Lionel S. Marks, Sixth Edition, copyright 1958 by McGraw-Hill Book Company, Inc. The sensing device can be repositioned, if necessary, to be closer to the opening in the bottom wall of the housing 10 communicating with the interior of the post 12. The remote indicating device can also be positioned in other locations, as on the exterior of the housing 10. The visible indicator can be a wheel or disc rotatable past a window opening, and carrying the words "on" and "off" to indicate the burner condition. The housing cover 74 has suitable window openings for the spark indicator bulb 52, and for the flame indicator 64. Another cover opening is provided for the pushbutton 54.

Figure 8:
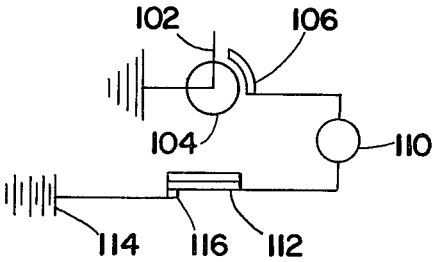
FIG. 8 is a schematic diagram of another control.

FIG. 8 shows an ignition indicator enabling or control arrangement or means wherein an electrical wiper or switch means 102 is connected with the knob 104 for operating the gas flow control valve for the burner 14. Rotation of the knob 104 clockwise to any on position will cause the wiper 102 to engage arcuate contact 106 connected with audible or visual ignition indicator 110, bimetal ignition sensor 112 and battery 114. The indicator 110 may be a buzzer, light or meter and will give a warning until the burner is ignited, whereupon the flame will cause the bimetal 112 to move away from the contact 116 and de-energize the indicator 110. This embodiment gives a warning indication whenever the gas supply is on and the burner is not ignited.

Figure 9:
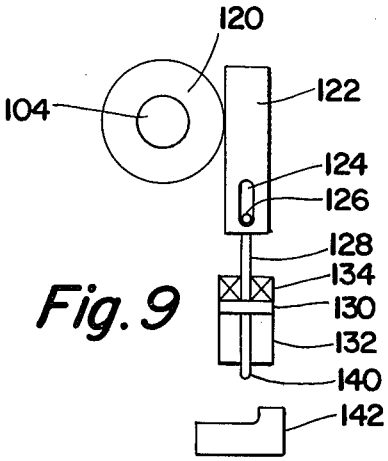
FIG. 9 is a schematic diagram of still another control arrangement.

FIG. 9 shows an arrangement wherein gas flow control valve control knob 104 is connected with an ignition disabling means for disabling the ignition control means from supplying electrical potential to the spark gap. The ignition disabling means includes a large toothed pinion 120 engaging a vertically slidable rack 122 having a slot 124 receiving a pin 126 on a stem 128 attached to a piston 130 in a dashpot 132. A spring 134 normally biases the piston 130 down in FIG. 9 to extend stem 140 into the path of a shoulder 142 on the pushbutton 52 of the ignition control means. When the knob 104 is turned clockwise to any on or flow permitting position, the rack 122 will move down far enough to allow movement of the pin 126 relative to the slot 124 far enough to move the stem 140 into the path of the shoulder 142. The dashpot can be one which takes around five seconds for the piston 130 to move fully down. This would allow around five seconds after the gas is turned on to effect ignition. Afterwards, the gas control knob 104 must be turned off to rearm the dashpot 132 before reignition can be attempted. This will warn the user to open the grill cover and vent same.

The bimetal 112 defines a deactivator means for deactivating the indicator 110 once the burner is ignited.

The arrangement of FIG. 9 provides a delay blocking means for blocking operation of the igniter control a predetermined time after the gas supply valve is turned on.

While there have been described what are at present considered to be the preferred embodiments of this invention, it will be obvious to those skilled in the art that various changes and modifications may be made therein without departing from the invention, and, it is aimed, therefore, in the appended claims to cover all such changes and modifications which fall within the true spirit and scope of the invention.

What is claimed is:

1. In a covered gas grill having a dished housing which is supported by a support structure, a gas burner disposed in the dished housing, and a gas flow control means for controlling the flow of gas to the gas burner, the gas flow control means being mounted on said support structure, an igniter and indicator system to enable an operator to prevent gas explosions comprising:

a mounting bracket disposed within the dished housing contiguous to the gas burner;

at least a first electrode for forming a spark gap with a metallic element, said first electrode being mounted on said mounting bracket;

spark indicator means for indicating the passage of an electrical spark between said first electrode and said metallic element, said spark indicator means being mounted on said mounting bracket;

a housing disposed on said supporting structure;

an ignition control means including a piezoelectric device for selectively supplying an electrical potential to said first electrode to cause a spark to jump the spark gap, said ignition control means being mounted in said housing and being operatively connected with said first electrode; and an ignition indicator means for providing visual indication of the ignition state of the burner, the ignition indicator being mounted in said housing and being operatively connected with the spark indicator means, wherein if ignition has not taken place, the state of said ignition indicator means serves as a warning to the operator that gas is accumulating in the grill and that the grill should be vented before an attempted relight of the gas burner to prevent an explosion on the attempted relight.

2. The grill as set forth in claim 1 wherein said ignition control means includes a voltage source for supplying the electrical potential to said first electrode and wherein said spark indicator is electrically connected in series with the voltage source and said first electrode.

3. The grill as set forth in claim 2 wherein said spark indicator means is a light which emits a flash of light as the electrical potential jumps the spark gap.

4. The grill as set forth in claim 3 wherein said metallic element is a second electrode, said second electrode being mounted on said mounting bracket and being operatively connected with the ignition control means.

5. The grill as set forth in claim 1 further including enabling means for enabling the ignition indicator means in response to the flow of gas to the gas burner, whereby the ignition indicator means indicates when gas is flowing and the combustion state is absent.

6. The grill as set forth in claim 5 wherein the spark indicator means and the ignition indicator means are electrical and wherein an electrical switch means is connected with the gas flow control means for selectively electrically connecting the spark indicator means and the ignition indicator means when gas is flowing to the gas burner.

7. An igniter and indicator system for a gas burner disposed in a covered housing to enable an operator to prevent gas explosions, comprising:

at least a first electrode for forming a spark gap with a metallic element, the first electrode being adapted to be disposed contiguous with the gas burner such that a spark jumping the spark gap is adapted to ignite gas from the burner;

an ignition control means including a piezoelectric device for selectively supplying electrical potential to said first electrode to cause a spark to jump the spark gap, the ignition control means being operatively connected with the first electrode;

a spark indicator means for indicating the jumping of a spark across the spark gap, the spark indicator means being operatively connected with the first electrode; and an ignition indicator means operatively connected with the spark indicator means for providing a visual indication of the sensed ignition state wherein if said ignition indicating means shows that ignition has not taken place, the operator is warned that gas is accumulating in the housing and that the housing should be vented before an attempted relight of the gas burner to prevent an explosion on the attempted relight.

8. The igniter and indicator system of claim 7 wherein the spark indicator is connected electrically, in series with the ignition control means and the first electrode.

9. The igniter and indicator system of claim 8 further including a mounting bracket on which said first electrode and spark indicator means are mounted to form a unitary sensing and igniting assembly for mounting contiguous to the burner; a housing in which said ignition control means, said spark indicator means and said ignition indicator means are mounted; and an elongated cable means extending between the housing and the unitary sensing and igniting assembly for providing the operative connection between the ignition control means and the first electrode and between the ignition sensing means and the ignition indicator means, whereby the ignition and indicator system is adapted to be added as a unit to a gas grill.

10. A covered gas grill provided with warning devices to enable an operator to prevent gas explosions, comprising:

a dished housing;

a supporting structure for supporting the dished housing;

a gas flow control valve for controlling the flow of gas to the gas burner, the gas valve being rotatable between gas flow permitting and blocking positions;

at least a first electrode for forming a spark gap with a metallic element, the first electrode being disposed contiguous with the gas burner for igniting gas with a spark jumping the spark gap;

spark indicator means disposed in the dished housing for indicating the passage of an electrical spark between said first electrode and said metallic element;

an ignition control means including a piezoelectric device for selectively supplying an electrical potential to the first electrode to cause a spark to jump the spark gap, the ignition control means being operatively connected with the first electrode;

ignition disabling means for selectively disabling the ignition control means from supplying electrical potential to the first electrode, the ignition disabling means being operatively connected with the ignition control means wherein if ignition is not achieved within a predetermined period of time said gas flow control valve would have to be returned to said blocking position before a relight could be attempted whereby the operator would be warned to open the gas grill to allow the gas therein to dissipate before said relight was attempted; and, an ignition indicator means for providing a visual indication of the ignition state of the gas burner, the ignition indicating means being operatively connected with the spark indicator means whereby if the indicator means does not light the operator would be warned that gas is accumulating in the grill.

11. The gas grill as set forth in claim 10 wherein the ignition disabling means includes a delay timing means for delaying the ignition control disabling for a predetermined time, the delay timing means being operatively connected with the gas flow control valve for starting the predetermined time in response to the gas supply valve being moved into the flow permitting position, whereby ignition is permitted when the gas valve is first moved to the flow permitting position and is disabled the predetermined time later.

* * * * *